US005569867A

United States Patent [19]

Levine

[11] Patent Number: 5,569,867

[45] Date of Patent: Oct. 29, 1996

[54] MUSICAL EDUCATION TOY

[76] Inventor: Jeffrey D. Levine, 838 S. Bond St. #2, Baltimore, Md. 21231

[21] Appl. No.: 500,499

[22] Filed: Jul. 11, 1995

[51] Int. Cl.[6] ..... G07B 15/00

[52] U.S. Cl. ..... 84/470 R; 84/404; 446/168; 446/172

[58] Field of Search ..... 84/402, 404; 446/166, 446/168, 170, 172

[56] References Cited

U.S. PATENT DOCUMENTS

| | | | |
|---|---|---|---|
| 1,586,769 | 6/1926 | Askin | 84/403 |
| 2,383,305 | 8/1945 | Greene | 446/143 |
| 2,504,456 | 4/1950 | Rundell | 84/404 |
| 2,504,457 | 4/1950 | Rundell | 84/404 |
| 2,738,697 | 3/1956 | Miller | 84/404 |
| 2,955,502 | 10/1960 | Ventura | 84/94.1 |
| 3,002,313 | 10/1961 | Hutchison | 446/9 |
| 3,477,332 | 11/1969 | Kreiss | 84/403 |
| 3,589,231 | 7/1990 | Postel | 84/102 |

*Primary Examiner*—Patrick J. Stanzione
*Attorney, Agent, or Firm*—Ostrolenk, Faber, Gerb & Soffen, LLP

[57] ABSTRACT

A musical education toy capable of receiving balls in a prearranged order, separating them according to size, and then guiding them to corresponding xylophone bars in order to play selected tunes. The toy has a track on which to place a plurality of balls, a hand crank to control the release of the balls, guide rails which allow the balls to drop into corresponding holes, chutes to further guide the balls to corresponding xylophone bars, and a box to collect the balls.

20 Claims, 2 Drawing Sheets

MUSICAL EDUCATION TOY

BACKGROUND OF THE INVENTION

1. Field of Invention

The present invention relates to a musical education toy and, more specifically, a self-playing toy xylophone device capable of playing selected tunes.

2. Description of the Related Art

Several self-playing toy xylophones have been devised. Some play only one tune, while others are capable of playing a limited number of selected tunes.

Self-playing xylophones capable of playing a single, predetermined tune usually play a simple scale. These devices are generally similar to each other in that the percussion striker, usually a ball, gravitationally or inertially moves along a path and progressively strikes sound elements.

The xylophone-type toys disclosed in U.S. Pat. No. 1,586,769 to Askin, U.S. Pat. No. 2,383,305 to Greene, U.S. Pat. No. 2,504,457 to Rundell, and U.S. Pat. No. 3,477,332 to Kreiss are single tune devices which are stepped in a manner resembling a staircase. A xylophone bar is placed on each step, the bars being arranged in a predetermined order, generally a standard scale. The ball will gravitationally roll successively from one step to the next lower step, striking each note in sequence.

The xylophone-type toys disclosed in U.S. Pat. No. 2,504,456 to Rundell, U.S. Pat. No. 2,738,697 to Miller, and U.S. Pat. No. 3,002,313 to Hutchison each use a passage to gravitationally guide the percussion striker, a ball or coin, to the xylophone bars. These bars are also struck in the predetermined order in which the bars are placed.

Other self-playing xylophone-type toys are capable of playing different tunes. For example, U.S. Pat. No. 3,589,231 to Postel and U.S. Pat. No. 2,955,502 to Ventura are capable of playing selected tunes by changing the instrumentality which guides the percussion strikers.

More specifically, Postel discloses a musical toy which resembles a record player having a particular pattern of holes into which marbles are placed. The record is placed on a special player and the marbles in the holes drop through guide holes in the top of the player and strike tone plates in a particular sequence to produce different musical tunes.

Ventura discloses a musical toy comprising a peg-board type of surface covered by a maze of holes. Each of these holes is capable of receiving a peg which, in turn, carries a tone-producing element.

Although toy-type xylophones heretofore known, such as those described above, are capable of self-playing a tune, they suffer from a number of disadvantages:

(a) they are capable of playing only one predetermined tune, or, if they can play selected tunes, the instrumentality must be changed, which is cumbersome;

(b) they have minimal musical education value for a child because a child may be either too young to manipulate the toys, or lack the interest to deal with the cumbersome aspects inherent in the toys;

(c) most lack the ability to easily vary the tempo of the tunes;

(d) most lack a unique visual effect; and (e) most of the ones that play selected tunes are complex to manufacture (i.e. Ventura with the complicated music box) or require the purchase of many different instrumentalities (i.e. records for Postel) to play selected tunes.

Unless a child is skilled in playing the toy as a musical instrument, the primary appeal of most known musical toys is limited to the initial stimulation of the child's basic sense of hearing and sound which results from the child's first attempts to play the toy as a musical instrument. Unfortunately, most young children do not have well developed musical skills, and, therefore, are very limited in their abilities to play musical toys as musical instruments. Thus, most known musical toys have only limited play value after their initial period of use.

It is well known that most young children are intrigued by visual experiences. For this reason, a musical toy which creates a simultaneous visual effect would have substantially greater play value for sustained time periods than is the case with most known musical toys. Such a musical toy would be particularly suitable for use by young children who do not have well developed musical skills. And, of course, such a musical toy should be both inexpensive to manufacture and safe and easy for use by young children.

Accordingly, the need exists for an educational musical toy that:

(a) is capable of easily, conveniently, and enjoyably playing an unlimited number of selected tunes;

(b) provides enhanced educational value for children by implementing an easy and simple to understand method for playing selected tunes;

(c) provides easily regulated tempos;

(d) provides unique visual effects to interest children; and (e) is relatively simple and inexpensive to manufacture (i.e. no electrical mechanisms), and comes complete with everything necessary to play selected tunes.

SUMMARY OF THE INVENTION

The present invention overcomes the deficiencies of the prior art noted above by providing a musical education toy in which selected tunes can be easily played. A tune can be selected, for example, from an included songbook, by a child who then lines up selected strikers (balls) in order on a track. The balls move along the track to a sorter, where they are selectively guided to respective percussion-type tone producers, such as xylophone bars. As the balls make their way from the track to the bars, the child will be amused and entertained by the unique visual effects. As the balls strike the xylophone bars, the child will be even more entertained by the playing of the tune. During the entire process, the fun keeps the child's interest constantly maintained, which allows for education of many aspects of music, e.g. notes, arrangement of notes, tempo, etc.

Accordingly, the present invention provides a musical toy having a base with a plurality of percussion-responsive sound-producing devices disposed on the base. A plurality of droppable strikers (such as balls) are provided, the balls having a feature, such as size, which distinguishes one from another, so that they can be sorted. A sequencing means holds the balls in a prearranged sequence and serially releases the balls in the prearranged sequence. A sorting means disposed above the sound-producing devices receives balls released from the sequencing means, sorts the balls according to size, and directs the sorted balls to drop onto one of the sound-producing devices in correspondence with the size of the balls.

The musical toy further can include optional regulating means disposed between the sequencing means and the sorting means for regulating the release of the balls from the sequencing means. Also, the musical toy can include a collector disposed on the base for receiving each of the plurality of balls after each of the balls drops selectively on each of the percussion responsive sound producing devices. As a further optional feature, the musical toy further includes means for elevating each of the balls from the collector to a position above the percussion responsive sound producing devices.

According to a preferred embodiment of the invention, the sorting means includes a pair of guide rails disposed in spaced relation next to each other. The guide rails have one end proximal to the sequencing means and another end distal to the sequencing means. The guide rails are spaced further from each other at the distal end than at the proximal end, such that the balls roll along and drop between the pair of guide rails, the larger balls dropping between the pair of guide rails toward the distal end. Additionally, the musical toy can include a surface disposed below the pair of guide rails, the surface having a series of holes of different sizes formed in it that correspond to the sizes of balls.

The regulating means preferably is a revolving disc with grooves, each groove being capable of accepting only one striker at a time. The revolving disc can be operated manually, or driven by a motor, for example.

According to various alternative aspects of the present invention, the strikers can be coins or tokens instead of balls. The strikers can differ from one another not in size, but in weight, shape, or any other physically distinguishable characteristic which can be readily sorted.

BRIEF DESCRIPTION OF THE DRAWINGS

Other features and advantages of the present invention will become apparent from the following description when read in conjunction with the accompanng drawings, in which.

DETAILED DESCRIPTION OF THE PREFERRED EMBODIMENTS

Figure 1:
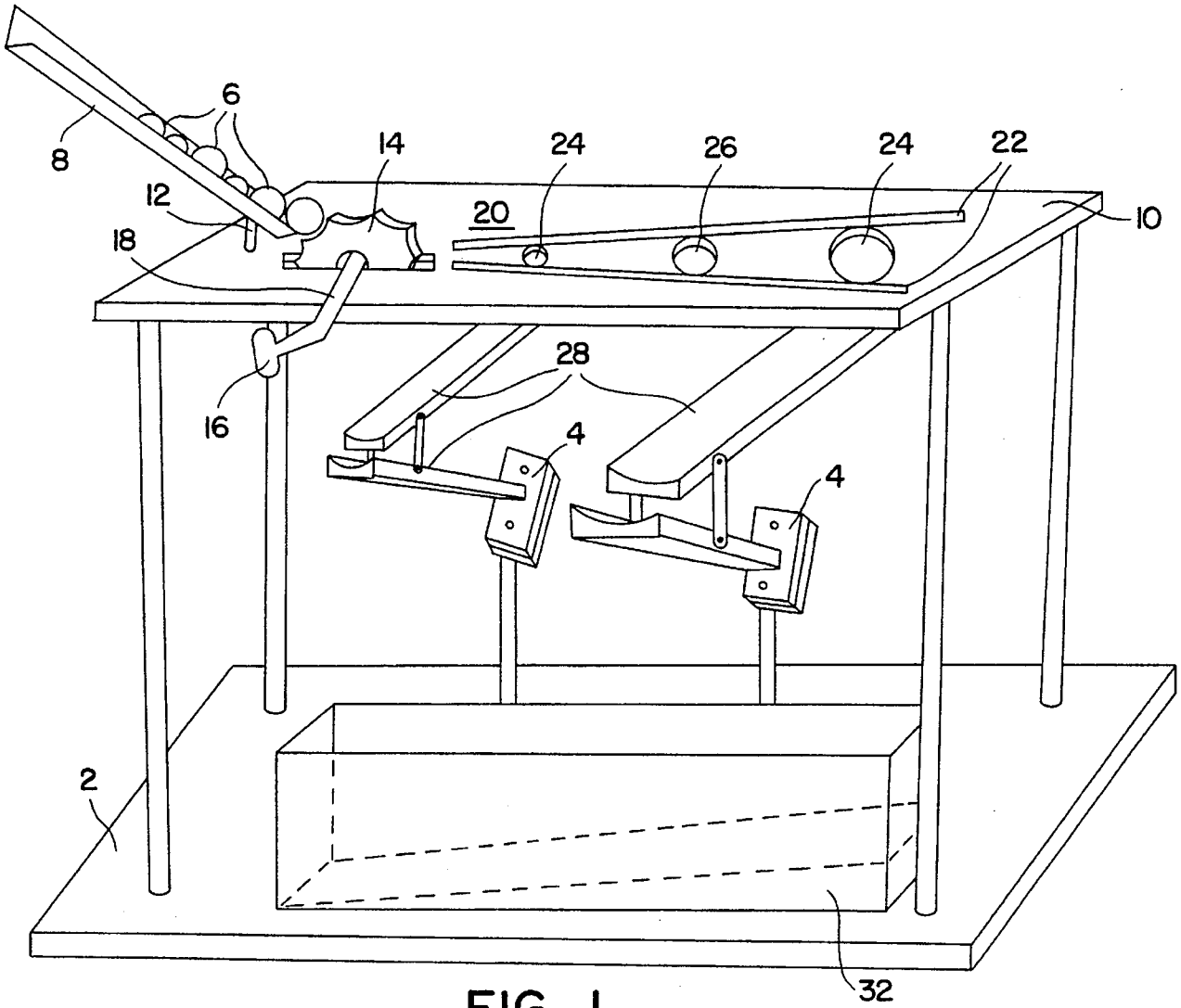
FIG. 1 is a perspective view of a musical toy according to a preferred embodiment of the present invention.

Referring to FIG. 1, a preferred embodiment of the invention is shown schematically in perspective view. The musical toy of the present invention includes a base 2, with a plurality of percussion-responsive sound producing devices, such as xylophone bars 4, disposed on the base.

The xylophone bars are of graduated lengths so as to produce different musical notes when struck, as is well known in xylophone art. The bars are mounted on support dowels with a layer of felt in between.

Droppable strikers, i.e., balls 6 of various sizes, are held in a prearranged sequence in a track 8. The track 8 is attached to a top surface 10 by supports 12. The balls are released serially from the track 8 in the prearranged sequence. The track is attached to the surface 10 at an angle steep enough, 45° for example, so that the balls are fed by gravity onto the track.

A regulator 14 disposed on the surface 10 receives the balls 6 from the track 8. The regulator 14 is turned by a handle 16, connected to the regulator by a shaft 18. The hand crank turns a circular disk that has a series of semi-circle shaped grooves cut around the perimeter. Each groove is of a size to pick up and transport one ball at a time. The handle of the hand crank extends out and up at a 45° angle with a knob attached to the end. The hand crank is held in place, but allowed to spin freely in a circular motion.

The balls 6 are delivered by rotation of the regulator 14 to a sorter 20. Sorter 20 is disposed above the base 2 and the plurality of xylophone bars 4 so as to receive the balls 6 as they are released from the track 8. The sorter 20 sorts each of the balls 6 with respect to the size of each ball and directs each of the sorted balls to drop onto one of the xylophone bars 4 in correspondence with the size of the ball 6.

The sorter 20 is formed of a pair of guide rails 22 disposed next to each other. The guide rails 22 have ends distal to the track 8 and proximal to the track 8. The guide rails are farther apart at the distal end than at the proximal end, such that each ball 6 rolls along the guide rails due to the force of gravity. The guide rails can be angled slightly downward from horizontal, if desired, although it is not necessary. The guide rails allow the balls to roll along because as the angle between the guide rails increases, the balls move lower and roll gravitationally forward.

When the ball reaches the point where the distance between the guide rails is greater than the. diameter of the ball, the ball drops between the two guide rails 22. A ball with a larger diameter will roll further along the guide rails than a ball of smaller diameter. Advantageously, the guide rails 12 are spaced from the surface 10 by an amount sufficient to keep the balls from touching the surface 10.

To assure predictable alignment of the dropping balls, a plurality of note holes 24, and a rest hole 26, are formed in the surface 10 between the guide rails 22. Note holes 24 and rest hole 26 are formed to correspond with the various sizes of balls 6. The note holes 24 are formed directly over chutes 28. Chutes 28 conduct the balls 6 to the corresponding xylophone bar 4. Rest hole 26 allows rest balls to drop through the sorter without striking a note, creating a silent pause in the tune.

Chutes 28 preferably are designed to provide a consistent tempo for the tune being played on the toy. As noted above, the sorter will select balls having a smaller diameter before it selects balls having a larger diameter. Accordingly, it takes more time for larger balls to drop through the sorter than smaller balls. Preferably, however, the period of time between release of a ball from regulator 14 and the ball striking corresponding xylophone bar 4 is substantially the same for each ball size. Accordingly, chutes 28 preferably present a longer path, and require a longer period of time, for a smaller ball to strike its corresponding xylophone bar. On the other hand, a larger ball is guided along a shorter corresponding chute 28 for a relatively shorter period of time, to compensate for the longer period of time the larger diameter ball spends moving along the sorter guide rails 22; thus, the period of time between the release of a ball from the track by the regulator, and striking of the bar, is substantially equal for all note-playing balls.

Figure 2:
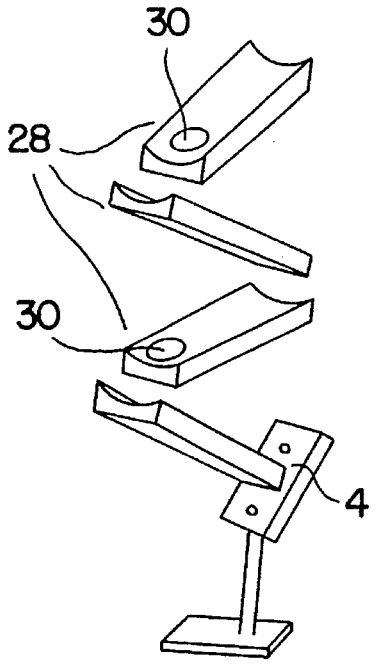
FIG. 2 is a perspective view of a set of chutes according to an alternative embodiment of the present invention.

Of course, various features can be incorporated in the design of chutes 28 to regulate the time spent by each ball on its respective chute. The chute's length, slope, surface, route, composition, shape, cross-section, number of turns, and obstacles are examples of some of the features that can be varied to change the amount of time each ball spends on its respective path before striking a note. As shown in FIG. 2, for example, chutes 28 present a relatively long path with several turns, which slow down the balls, and have holes 30 which further slow travel the balls.

In general, chutes 28 also direct the striking balls toward their respective xylophone bars at an angle appropriate to the orientation of the bars. The angle of the chute therefore regulates the speed at which the ball strikes the bar. Each series of chutes is at a slightly different angle to increase or decrease the velocity of different size or different weight balls in order control the volume of the note. Both of these variables must be considered in determining the length and angle of each track in the series. The chutes also may be padded, particularly in areas that receive a dropping ball, to reduce noise.

In an alternative embodiment, no chutes are used, or approximately vertical chutes are used, the bars being placed substantially horizontally and directly below the respective sorter holes, each bar being spaced in a stepped arrangement an appropriate distance below each hole to provide the correct timing for each ball.

The musical toy optionally also includes a collector 32 disposed on the base, the collector receiving each of the plurality of striker balls after dropping selectively on xylophone bars 4. Alternatively, a plurality of separate collectors could be provided, disposed adjacent each xylophone bar. The collecting box is disposed to catch all note striking and spacer balls. The bars are at an angle to redirect the trajectory of the balls to land in the collecting box 32. The box preferably is lined with foam padding, for example, to reduce noise. The bottom of the collecting box is angled to allow all the balls to roll to one end for convenient collection, as well as to prevent balls from striking each other, thereby further reducing noise. The hole for spacer balls is directly over a collecting box 32 to allow the spacer ball to fall directly in, or it could have a chute that ends over the collecting box, without striking a note.

Figure 3:
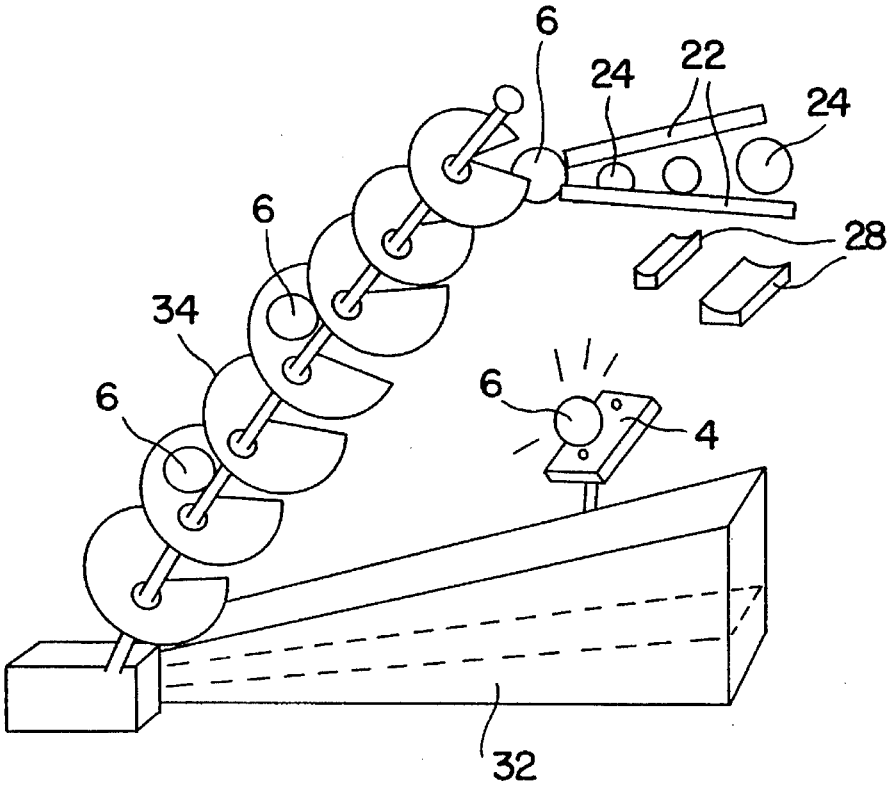
FIG. 3 is a schematic perspective view showing a return device for returning balls to an elevated position in the machine.

In a further variation, shown schematically in FIG. 3, a ball return system 34 is provided for returning the balls to the track 8 or the sorter 20, whereby the toy can play continuously.

In the operation of the invention, the user first selects a tune by arranging balls 6 in the appropriate order in primary track 8. The user then rotates hand crank 16 to pick up the arranged balls one at a time and transport them to the set of guide rails 22. As the balls roll along the guide rails, they will drop into their corresponding holes 24, 26. After falling through the holes, rest balls will land in collecting box 32 or note-striking balls will land in chutes 24. Note-striking balls will then roll along the chutes until they strike corresponding xylophone bars 4. The series of strikes and rests creates a tune.

Although the description above contains many specificities, these should not be construed as limiting the scope of the invention but as merely providing illustrations of some of the presently preferred embodiments of this invention. For example, the invention can have other forms of infrastructure such as a mountain or volcano; the chutes and other guides can be curved; the hand crank can be motorized and shaped in other ways to control the release of the balls; the toy can use coins as percussion strikers and collect them as would a coin bank; etc.

Thus, although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A musical toy comprising:

a base;

a plurality of percussion-responsive sound producing devices disposed on the base;

a plurality of droppable strikers, each striker having a property distinguishing at least one of the strikers from each of the other strikers;

sequencing means for holding the plurality of strikers in a prearranged sequence and serially releasing the strikers in the prearranged sequence; and sorting means disposed above the plurality of sound producing devices for receiving strikers released from the sequencing means, sorting the strikers with respect to the distinguishing property of each striker, and directing each of the sorted strikers to drop onto one of the plurality of sound producing devices in correspondence with the distinguishing property of each striker.

2. The musical toy of claim 1, further comprising regulating means disposed between the sequencing means and the sorting means for regulating the release of the strikers from the sequencing means.

3. The musical toy of claim 1, further comprising a collector disposed on the base for receiving each of the plurality of strikers after each of the strikers drops selectively on each of the percussion responsive sound producing devices.

4. The musical toy of claim 3, further comprising means for elevating each of the plurality of strikers from the collector to a position above the sorting means.

5. The musical toy of claim 1, wherein the plurality of droppable strikers comprises a plurality of balls, and the distinguishing property is the size of the balls, some of the balls being larger than others.

6. The musical toy of claim 5, wherein the sorting means comprises a pair of guide rails disposed in spaced relation next to each other and having one end proximal to the sequencing means and another end distal to the sequencing means, the guide rails being spaced farther from each other at the distal end than at the proximal end, such that the balls roll along and drop between the pair of guide rails, the larger balls dropping between the pair of guide rails toward the distal end.

7. The musical toy of claim 6, further comprising a surface disposed below the pair of guide rails, the surface having a series of holes of different sizes formed therein corresponding to the sizes of balls.

8. The musical toy of claim 1, wherein the regulating means is a revolving disc with grooves for accepting only one striker at a time.

9. The musical toy of claim 8, wherein the revolving disc is operated manually.

10. The musical toy of claim 1, wherein the distinguishing property of the strikers is size.

11. A musical toy comprising:

a base;

a plurality of percussion-responsive sound producing devices disposed on the base;

a plurality of droppable strikers, each striker having a property distinguishing at least one of the plurality of strikers from each of the other strikers;

a track on which the strikers are placed in a prearranged sequence, the strikers being released serially from the track in the prearranged sequence; and a sorter disposed above the plurality of sound producing devices so as to receive strikers released from the track, the sorter sorting each of the plurality of strikers with respect to the distinguishing property of each striker and directing each of the sorted strikers to drop onto one of the plurality of sound producing device in correspondence with the distinguishing property.

12. The musical toy of claim 11, further comprising a regulator disposed between the track and the sorter for regulating the release of the strikers from the track.

13. The musical toy of claim 11, further comprising a collector disposed on the base for receiving each of the plurality of strikers after dropping selectively on the percussion responsive sound producing devices.

14. The musical toy of claim 13, further comprising a lift for elevating each of the plurality of strikers from the collector to a position above the sorter.

15. The musical toy of claim 11, wherein the plurality of droppable strikers comprises a plurality of balls, and the distinguishing property is the size of the balls, some of the balls being larger than others.

16. The musical toy of claim 15, wherein the sorter comprises a pair of guide rails disposed next to each other in spaced relation and having one end proximal to the track and another end distal to the track, the guide rails being spaced farther from each other at the distal end than at the proximal end such that the balls roll along and drop between the pair of guide rails, the larger balls dropping between the pair of guide rails toward the distal end.

17. The musical toy of claim 16, further comprising a surface disposed below the pair of guide rails, the surface having a series of holes of different sizes formed therein corresponding to the sizes of balls.

18. The musical toy of claim 11, wherein the regulator is a revolving disc with grooves for accepting only one striker at a time.

19. The musical toy of claim 18, wherein the disc is revolved manually.

20. The musical toy of claim 11, wherein the distinguishing property is size.

* * * * *